US005387353A

United States Patent [19]

Nader

[11] Patent Number: 5,387,353

[45] Date of Patent: Feb. 7, 1995

[54] LUBRICITY ADDITIVES FOR HIGH TEMPERATURE LUBRICANTS

[75] Inventor: Bassam S. Nader, Midland, Mich.

[73] Assignee: The Dow Chemical Company, Midland, Mich.

[21] Appl. No.: 146,564

[22] Filed: Nov. 2, 1993

[51] Int. Cl.[6] ..... C10M 137/00

[52] U.S. Cl. ..... 252/46.6; 252/49.9

[58] Field of Search ..... 252/46.6, 46.7, 49.8, 252/49.9

[56] References Cited

U.S. PATENT DOCUMENTS

| | | | |
|---|---|---|---|
| 2,694,083 | 11/1954 | Moreton et al. | 260/461 |
| 2,890,235 | 6/1959 | Raley | 260/461 |
| 3,384,685 | 5/1968 | Boschan | 260/966 |
| 4,171,271 | 8/1979 | Weil | 252/46.6 |
| 5,196,130 | 3/1993 | Gschwender | 252/49.9 |

OTHER PUBLICATIONS

Gschwender, Lois J. et al. "Synthesis and Characterization of a High-Temperature, Low-Volatility Phosphate Additive for Aerospace Applications," *Lubr. Eng.*, 41, pp. 935-938 (1991).

*Primary Examiner*—Stephen Kalafut
*Assistant Examiner*—Cephia D. Toomer
*Attorney, Agent, or Firm*—Robert M. O'Keefe

[57] ABSTRACT

Compositions useful for lubricating aircraft turbines comprising:

(a) a lubricating fluid base stock and (b) a phosphorous-containing compound including aryl diarenephosphinates, diaryl arenephosphonates and arenephosphonothioates.

19 Claims, No Drawings

LUBRICITY ADDITIVES FOR HIGH TEMPERATURE LUBRICANTS

The U.S. Government has a paid-up license in this invention and the right in limited circumstances to require the patent owner to license others on reasonable terms as provided by the terms of contract no. F33615-89-C-2918 awarded by the U.S. Air Force.

BACKGROUND OF THE INVENTION

This invention concerns lubricity enhancing additives for high temperature lubricants such as polyphenyl ethers.

Numerous high temperature lubricants, used at operating temperatures greater than 300° C., are stable to degradation and oxidation, but possess less than desirable lubricity. Hence, lubricity (antiwear) additives are highly sought for addition to the high temperature lubricants. The lubricity additives must also possess good stability and resist degradation and oxidation at the high temperatures.

SUMMARY OF THE INVENTION

This invention, in one respect, is a composition useful for lubricating aircraft turbines, comprising:

(a) a lubricating fluid base stock and (b) a phosphorous-containing compound of Formula I:

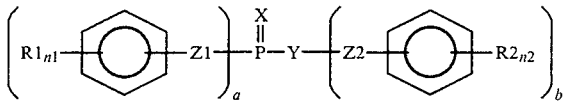

wherein a equals 1 or 2, b equals 1 or 2, X is oxygen or sulfur; Z1 and Z2 are independently in each occurrence a covalent bond or oxygen; Y is a covalent bond or is a diradieal group of Formula II:

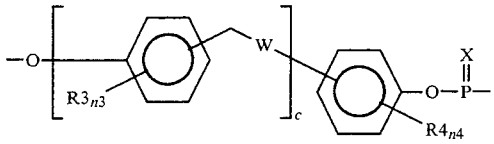

wherein c equals 0 or 1; R1, R2, R3 and R4 are independently in each occurrence aryl of up to 12 carbons, alkyl of up to 6 carbons, alkoxy of up to 6 carbons, polyhaloalkyl of up to 6 carbons, polyhaloalkyoxy of up to 6 carbons, halo, aryl of up to 12 carbons or aryloxy of up to 12 carbons wherein if R1, R2, R3 or R4 is aryloxy the aryloxy can be substituted by one or more R1, R2, R3 or R4; W is a covalent bond, O, S, $SO_2$, $C(CH_3)_2$, $C(CF_3)_2$, or 9,9'-fluorenee; n1 is 0 to 5; n2 is 0 to 5; n3 is 0 to 5; n4 is 0 to 5; with the provision that R1, R2, R3 and R4 are not hydroxy and with the provision that phosphorus is bonded to at least two oxygens.

DETAILED DESCRIPTION OF THE INVENTION

The phosphorus-containing lubricity additives of this invention correspond to the compounds described above in Formula I. The amount of phosphorus-containing compounds used in the composition of this invention which contains a lubricating fluid base stock is preferably greater than about 0.1 weight percent based on the total weight of the composition, more preferably greater than about 0.5 weight percent, most preferably greater than about 1 weight percent; preferably less than about 10 percent, and more preferably less than about 5 weight percent, and most preferably less than about 2 weight percent.

In Formula I, R1, R2, R3 and R4 are preferably independently in each occurrence methyl, methoxy, polyhalomethyl, polyhalomethoxy, halo or aryloxy. More preferably, R1, R2, R3 and R4 are independently in each occurrence methyl, methoxy, polyfluoromethyl, polyfluoromethoxy, fluoro or phenyloxy. A first preferred class of phosphorous-containing compounds, known as diaryl are nephosphonates and arenephosphonothioates, are those of Formula I wherein a is 1; b is 2; n1 is Or Z1 is a covalent bond, Z2 is oxygen, and Y is a covalent bond. More preferably in this first preferred classy n2 is 1 and R2 is phenoxy or chlorophenoxy. In the first preferred class of phosphorous-containing compounds X is preferably sulfur. A second preferred class of phosphorous-containing compounds known as aryl diarenephosphinates, of Formula I are those wherein X is oxygen, a and b are 2, and Z1 and Z2 are covalent bonds. In the second preferred class, c is preferably 0. In the second preferred class of phosphorous-containing compounds, n1, n2, n3 and n4 are preferably 0. More preferably in the second preferred class, a and b are 2, X is oxygen and c is 1. More preferably in the second preferred class, Z1 and Z2 are covalent bonds. More preferably in the second preferred class, n1, n2, n3 and n4 are 0.

The phosphorus-containing additives, or precursors to the phosphorus-containing compounds can be prepared by well known organic synthetic techniques. Typically, the phosphorous-containing compounds can be prepared by contacting a phosphorus acid chloride with an appropriate phenol in a solvent such as pyridine, triethylamine, methylene chloride, chloroform, or mixtures thereof in the presence of a base such as pyridine, triethylamine, or dipotassium carbonate. The reaction can be enhanced by using catalysts such as 4-dimethylaminopyridine. At the conclusion of the reaction, the products can be isolated by standard organic extractive techniquest and later purified if desired by techniques such as crystallization and chromatography.

Examples of phosphorus acid chloride that can be used to prepare the phosphorus-containing compounds of this invention include benzenephosphonic dichloride, diphenylphosphinyl chloride, and benzenephosphonic dichloride. Examples of phenols that can be used to prepare the phosphorus-containing compounds of this invention include 4-phenoxyphenol, 4-(4-chlorophenoxy)phenol, resorcinol, 4,4'-dihydroxybiphenyl, bisphenol A, 4,4'-hexafluoroisopropylidenediphenol, 4,4'-oxydiphenol, 4,4'-thiodiphenol, 4,4 '-sulfonyldiphenol, and 9,9-bis( 4-hydroxyphenyl ) fluorene.

In the composition of this invention, a lubricating fluid base stock is employed. Suitable lubricating fluids which can be used with the aryl ether sulfones of this invention include, for example, hydrocarbon lubricants such as mineral oil; alpha-olefin fluids; silicone fluids and greases; polyalkyl ether fluids; perfluoroalkyl ethers and greases; ester lubricants such as pentaerythritol esters and trimethylol alkane esters; polyaryl ether fluids such as polyphenyl ether; and phosphazene fluids. Preferably, the lubricating fluid is a polyphenyl ether fluid.

To prepare a composition, the phosphorus-containing compound is dissolved in an acceptable organic solvent such as methylene chloride and this solution is mixed with a solution of the lubricating fluid to thereby admix the compounds. The mixture is then preferably filtered to remove any solid impurities and then the organic solvents are removed from the lubricant composition such as by evaporation or distillation. The phosphorus-containing compounds can also be added directly to the lubricating fluid followed by admixing to disperse the sulfones. In addition, the phosphorus-containing compounds may be directly added to a lubricating fluid and then admixed.

The following examples are provided to illustrate the invention and should not be construed as limiting the scope of this invention. All amounts and percentages are by weight unless noted to the contrary. All reagents were obtained from commercial sources and used without purification. HPLC analyses were performed on a Hewlett-Packard 1090A Liquid Chromatography unit using a Hewlett-Packard ODS Hypersil (C18) reverse-phase column (5 $\mu$m, 100×2.1 mm), with UV detector operating at 254 nm. Melting points were determined in open capillary tubes, and are uncorrected. A Varian VXR300 instrument was employed to record the $^1$H-NMR (300 MHz), and the $^{13}$C-NMR (75.4 MHz), using tetramethylsilane (0 ppm) as an internal standard.

Oxidative Stability Determinations

In the Examples, Pressure Differential Scanning Calorimetry (PDSC) was used to determine the thermooxidative stability of the materials described in this study. The PDSC runs were performed on a DuPont Instruments 910 Differential Scanning Calorimeter with a DuPont Instruments 1090B Thermal Analyzer control unit, using aluminum pans under $1.38\times10^6$ Pa (200 psi) oxygen pressure and a flow rate of 50 cc min$^{-1}$. The instrument was programmed to raise the temperature at a rate of 15° C. min$^{-1}$. Two data points were reported: the onset of oxidation, and the extrapolated temperature of major oxidation exotherm. The latter data point was obtained by extrapolating the major oxidation exotherm curve tangentially at the point of maximum slope, and noting the intercept with the temperature coordinate.

Example 1: Bis(4-phenoxyphenyl) Benzenephosphonate

An oven-dried 100 mL 3-necked flask equipped with a magnetic stirring bar, a reflux condenser carrying a $CaCl_2$-Drierite drying tube, and a heating mantle was charged with 4-phenoxyphenol (9.2 g, 49.4 mmol), 4-dimethylaminopyridine (0.6 g, 4.9 mmol), and anhydrous pyridine (40 mL), and the stirred solution was treated slowly with benzenephosphonic dichloride (3.5 mL, 24.7 mmol) via syringe. The resulting mixture was stirred at ambient temperature for 64 hours, then was heated at reflux for 1 hour, and allowed to cool. The reaction was monitored periodically by HPLC. Workup consisted of partitioning the reaction mixture between $CH_2Cl_2$ (100 mL) and water (100 mL) then washing the organic phase successively with 100 mL portions of 5 percent NaOH water, 5 percent HCl, water and saturated brine. Drying ($MgSO_4$), filtration and concentration gave a red oily residue which solidified on standing. Recrystallization from MeOH-$H_2O$ gave 9.8 g (80 percent yield) of the title compound as off-white prisms, m.p. 92–3° C. which had a PDSC ($O_2$) onset/extrap. (° C.) of 310/337.

Example 2: 4- (4-Chlorophenoxy) phenol and Bis[4-( 4-chloro ) phenoxyphenyl] Benzenephosphonate The 4-(4-chlorophenoxy)phenol precurser was prepared as follows. A 1 L 3-necked flask equipped with a mechanical stirrer, a Dean-Stark trap carrying a reflux condenser, and a heating mantle, was charged with 4-methoxyphenol (35.9 g, 0.29 mol), 85 percent KOH (19.1 g, 0.29 mol) and p-xylene (350 mL), and the mixture was heated at reflux for 1 hour, thus removing the water of reaction azeotropically. The mixture was cooled, and 1-chloro-4-iodobenzene (69 g, 0.29 mol), copper powder (2.9 g, 46 mmol), and cuprous chloride (2.9 g, 29 mmol) were added and the mixture was heated at reflux for 20 hours. The reaction was monitored periodically by HPLC. Workup consisted of diluting the cooled mixture with $Et_2O$ (200 mL), filtration through a medium-fritted funnel, and concentration of the filtrate to leave a deep dark oily residue. This crude material, consisting primarily of 4-(4-chlorophenoxy)anisole, was treated with glacial acetic acid (275 mL) and 48 percent HBr (105 mL), and the mixture was heated at reflux for 24 hours. Workup consisted of partitioning the mixture between $H_2O$ (1.2 L) and $CH_2Cl_2$ (0.5 L), washing the organic phase with $H_2O$ (0.5 L), and concentration to leave a deep dark oil residue. This residue was taken up in ethanol (0.5 L) and treated with activated carbon (Norit; 50 g). Filtration through celite, and concentration of the filtrate gave the crude 4-(4-chlorophenoxy)phenol as a thick, red oil. Further purification of the product was achieved by chromatography on a column packed with flash-grade silica gel (6"×2" i.d.), eluting with $CH_2Cl_2$, to give after concentration a pinkish solid, which was subsequently recrystallized from hexane-EtOAc to give 31.4 g (49% yield) of the pure product as off-white prisms m.p. 85–86° C.

Next, the bis[4-(4-chloro)phenoxyphenyl] benzenephosphonate was prepared. An oven-dried 100 mL 3-necked flask equipped with a magnetic stirring bar, a reflux condenser carrying a $CaCl_2$-Drierite drying tube, and a heating mantle, was charged with 4-(4-chlorophenoxy)phenol (9.4 g, 42.6 mmol), 4-dimethylaminopyridine (0.51 g 4.2 mmol), and anhydrous pyridine (40 mL), and the stirred solution was treated slowly with benzenephosphonic dichloride (3 mL, 21.1 mmol) via syringe. The resulting mixture was stirred at ambient temperature for 64 hours, then was heated at reflux for 1 hour, and allowed to cool. The reaction was monitored periodically by HPLC. Workup consisted of partitioning the reaction mixture between $CH_2Cl_2$ (100 mL) and water (100 mL), then washing the organic phase successively with 100 mL portions of 5 percent NaOH, water, 5 percent HCl, water, and saturated brine. Drying ($MgSO_4$), filtration and concentration gave a red oily residue. Purification by chromatography on flash-grade silica gel (4"×2" i.d.), eluting with $CH_2Cl_2$, afforded 9.3 g (78 percent yield) of the title compound as a yellow, viscous oil which had a PDSC ($O_2$) onset/extrap (° C.) of 310/357.

Example 3: Bis(4-phenoxyphenyl) Benzenephosphonothioate

An oven-dried 100 mL 3-necked flask equipped with a magnetic stirring bar, a reflux condenser carrying a $CaCl_2$-Drierite drying tube, and a heating mantle, was charged with 4-phenoxyphenol (8.64 g, 46.4 mmol), 4-dimethylaminopyridine (0.57 g, 4.7 mmol), and anhydrous pyridine (40 mL), and the stirred solution was treated slowly with benzenephosphonothioic dichloride (3.6 mL, 23.2 mmol) via syringe. The resulting mixture was stirred at ambient temperature for 64 hours, then was heated at reflux for 1 hour, and allowed to cool. The reaction was monitored periodically by HPLC. Workup consisted of partitioning the reaction mixture between $CH_2Cl_2$ (100 mL) and water (100 mL), then washing the organic phase successively with 100 mL portions of 5 percent NaOH, water, 5 percent HCl, water, and saturated brine. Drying ($MgSO_4$) filtration and concentration gave a red oily residue. Purification by chromatography on flash-grade silica gel (4"×2" i.d.), eluting with $CH_2Cl_2$, afforded 9.3 g (79 percent yield) of the title compound as a yellow, viscous oil which had a PDSC ($O_2$) onset/extrap (° C.) of 248/324.

Example 4: Bis[4-(4-chloro)phenoxyphenyl] Benzenephosphonothioate

An oven-dried 100 mL 3-necked flask equipped with a magnetic stirring bar, a reflux condenser carrying a $CaCl_2$-Drierite drying tube, and a heating mantle, was charged with 4-(4-chlorophenoxy)phenol (9.1 g., 41.2 mmol), 4-dimethylaminopyridine (0.5 g, 4.1 mmol), and anhydrous pyridine (40 mL), and the stirred solution was treated slowly with benzenephosphonothioic dichloride (3.2 mL, 20.6 mmol) via syringe. The resulting mixture was stirred at ambient temperature for 64 hours, then was heated at reflux for 1 hour, and allowed to cool. The reaction was monitored periodically by HPLC. Workup consisted of partitioning the reaction mixture between $CH_2Cl_2$ (100 mL) and water (100 mL), then washing the organic phase successively with 100 mL portions of 5 percent NaOH, water, 5 percent HCl, water, and saturated brine. Drying ($MgSO_4$), filtration and concentration gave a red oily residue. Purification by chromatography on flash-grade silica gel (4"×2" i.d), eluting with $CH_2Cl_2$, afforded 9.7 g (81 percent yield) of the title compound as a yellow, viscous oil which had a PDSC ($O_2$) onset/extrap (° C.) of 246/342.

Example 5: Four Ball Tests

The title compounds of Examples 1 and 4 were evaluated as lubricity additives to commercial 5P4E polyphenyl ether fluid ("SP4E PPE fluid") at 1 percent loading using the Four-Ball lubricity test method. The test conditions and results are summarized in Table I. In run 2, the title compound of Example 1 was used. In run 3, the title compound of Example 4 was used. It can be readily seen that additives provide wear-scar reduction; thus, lubricity is decreased on addition of the title compounds.

TABLE I

| Sample | Average Wear Scar Diameter (mm) 75° C./15 Kg Load(2) | Average Wear Scar Diameter (mm) 204° C./7 Kg Load(2) |
|---|---|---|
| Run 1) 5P4E PPE Fluid(1) | 1.73 | 0.83 |
| Run 2) 5P4E PPE Fluid +1% additive | 1.18 | 0.59 |
| Run 3) 5P4E PPE Fluid +1% additive | 1.34 | 0.55 |

(1)Not an embodiment of this invention.
(2)M-50 Steel Balls, 600 rpm, 1 hour

Example 6: 1,3-Bis(diphenylphosphinyloxy)benzene

An oven-dried 100 mL 3-necked flask equipped with a magnetic stirring bar, a reflux condenser carrying a $CaCl_2$-Drierite drying tube, and a heating mantle, was charged with resorcinol (2.2 g, 20 mmol), 4-dimethylaminopyridine (0.5 g, 4.1 mmol), and anhydrous pyridine (35 mL), and the stirred solution was treated slowly with diphenylphosphinyl chloride (8 mL, 41.9 mmol) via syringe. The resulting mixture was heated at reflux for 7 hours, then was allowed to stand at room temperature for 16 hours. The reaction was monitored periodically by HPLC. After completion of the reaction, the mixture was partitioned between water (100 mL) and $CH_2Cl_2$-$Et_2O$ (1:3, 250 mL), and the organic phase was washed successively with 50 mL portions of vap, leaving 7.6 g of a white solid residue. Recrystallization from hexane-EtOAc gave 7.3 g (71 percent yield) of the title compound as fine white prisms, m.p. 130–130.5° C. which had a PDSC ($O_2$) onset/extrap (° C.) of 329/258.

Example 7: 4,4'-Bis(diphenylphosphinyloxy)biphenyl

An oven-dried 100 mL 3-necked flask equipped with a magnetic stirring bar, a reflux condenser carrying a $CaCl_2$-Drierite drying tube, and a heating mantle, was charged with 4,4'-biphenol (3.2 g, 17.2 mmol), 4-dimethylaminopyridine (0.42 g, 3.4 mmol), and anhydrous pyridine (35 mL), and the stirred solution was treated slowly with diphenylphosphinyl chloride (7.2 mL, 37.7 mmol) via syringe. The resulting mixture was heated at reflux for 7 hours, then was allowed to stand at room temperature for 16 hours. The reaction was monitored periodically by HPLC. After completion of the reaction, the solid mass that had formed was shaken thoroughly with a mixture of water (200 mL) and ethanol (50 mL), then was filtered under suction, and the white solid was washed with ethanol-water (1:3; 200 mL). Recrystallization was effected by dissolving the solid in tetrahydrofuran with heating, then diluting the solution with an equal volume of hexane and allowing it to stand. Obtained was 9.4 g (93 percent yield) of the title compound as fine white prisms, m.p. 233–234° C. which had a PDSC ($O_2$) onset/extrap (° C.) of 328/348.

Example 8: 2,2-Bis[4(diphenylphosphinyloxy)phenyl]-propane

An oven-dried 100 mL 3-necked flask equipped with a magnetic stirring bar, a reflux condenser carrying a $CaCl_2$-Drierite tuber and a heating mantle, was charged with 4,4'-isopropylidenediphenol (3.6 g, 15.8 mmol), 4-dimethylaminopyridine (0.39 g, 3.2 mmol), and anhydrous pyridine (35 mL), and the stirred solution was treated slowly with diphenylphosphinyl chloride (6.5 mL, 34.1 mmol) via syringe. The resulting mixture was heated at reflux for 7 hours, then was allowed to stand at room temperature for 16 hours. The reaction was monitored periodically by HPLC. After completion of the reaction, the mixture was partitioned between water (100 mL) and $CH_2Cl_2$-$Et_2O$ (1:3;250 mL), and the organic phase was washed successively with 50 mL portions of 5 percent NaOH, water, 5 percent HCl water and brine, then it was dried ($MgSO_4$), filtered and concentrated on the rotavap to leave 9.42 g of a faintly yellowish thick oil which set on standing to a brittle glassy material. Crystallization was effected by dissolving the material in a minimum amount of EtOAc with heating then diluting the solution with hexane and allowing it to stand in a freezer at −25° C. overnight. This afforded 9.1 g (92 percent yield) of the title compound as white prisms, m.p. 71–72° C. which had a PDSC ($O_2$) onset/extrap (° C.) of 316/347.

Example 9:
2,2-Bis[4-(diphenylphosphinyloxy)phenyl]-1,1,1,3,3,3-hexafluoropropane An oven-dried 100 mL 3-necked flask equipped with a magnetic stirring bar, a reflux condenser carrying a $CaCl_2$-Drierite drying tube, and a heating mantle, was charged with 4,4'-hexafluoroisopropylidenediphenol (4.6 g, 13.7 mmol) 4-dimethylaminopyridine (0.33 g, 2.7 mmol), and anhydrous pyridine (35 mL), and the stirred solution was treated slowly with diphenylphosphinyl chloride (6 mL, 31.4 mmol) via syringe. The resulting mixture was heated at reflux for 7 hours, then was allowed to stand at room temperature for 16 hours. The reaction was monitored periodically by HPLC. After completion of the reaction, the mixture was partitioned between water (100 mL) and $CH_2Cl_2$-$Et_2O$ (1:3; 250 mL), and the organic phase was washed successively with 50 mL portions of 5 percent NaOH, water, 5 percent HCl, water and brine, then it was dried ($MgSO_4$), filtered and concentrated. The residual oil was shaken thoroughly with a mixture of water (100 mL) and ethanol (25 mL), resulting in the separation of an off-white gummy solid. This material was dissolved in $CH_2Cl_2$ (35 mL), and filtered under 5 psi pressure through a column packed with flash-grade silica gel (3"×2" i.d.), eluting with $Et_2O$ (0.5 L); concentration of the filtrate left 8.3 g (82 percent yield) of the title compound as a white foamy solid which had a PDSC ($O_2$) onset/extrap (° C.) of 354/383..

Example 10: Bis[4-(diphenylphosphinyloxy)phenyl] Ether

An oven-dried 100 mL 3-necked flask equipped with a magnetic stirring bar, a reflux condenser carrying a $CaCl_2$-Drierite drying tube, and a heating mantle, was charged with 4,4'-oxydiphenol (Pfaltz & Bauer; contains ca. 14 percent of the 2,4-oxydiphenol and ca. 3 percent of the 2,2-oxydiphenol) (3.4 g, 16.8 mmol), 4-dimethylaminopyridine (0.4 g, 3.3 mmol), and anhydrous pyridine (35 mL), and the stirred solution was treated slowly with diphenylphosphinyl chloride (7 mL, 36.7 mmol) via syringe. The resulting mixture was heated at reflux for 7 hours, then was allowed to stand at room temperature for 16 hours. The reaction was monitored periodically by HPLC. After completion of the reaction, the mixture was partitioned between water (100 mL) and $CH_2Cl_2$-$Et_2O$ (1:3; 250 mL), and the organic phase was washed successively with 50 mL portions of 5 percent NaOH, water, 5 percent HCl, water and brine, then it was dried ($MgSO_4$), filtered and concentrated on the rotavap to leave 7.03 g of a thick yellow oily residue. Numerous attempts to crystallize this product from a variety of solvents were unsuccessful. The material was taken up in $CH_2Cl_2$ and filtered under 5 psi through a column packed with flash-grade silica gel (3"×2" i.d) eluting with $Et_2O$ (0.5 L). Concentration gave 6.45 g (64 percent yield) of a thick oily residue, which was a mixture of the title compound (major), and the 2,4-isomer and 2,2-isomer. On standing, a small amount of the title compound crystallized and was collected, washed with methanol, and dried to give 0.34 g of crystals, m.p. 110–112° C. Several attempts to crystallize the bulk of the product from a variety of solvents with seeding were unsuccessful. The material exhibited a PDSC ($O_2$) onset/extrap (° C.) of 308/347.

Example 11: Bis[4-diphenylphosphinyloxy)phenyl] Sulfide

An oven-dried 100 mL 3-necked flask equipped with a magnetic stirring bar, a reflux condenser carrying a $CaCl_2$-Drierite drying tube, and a heating mantle, was charged with 4,4'-thiodiphenol (3.6 g, 16.5 mmol), 4-dimethylaminopyridine (0.4 g, 3.3 mmol), and anhydrous pyridine (35 mL), and the stirred solution was treated slowly with diphenylphosphinyl chloride (7 mL, 36.7 mmol) via syringe. The resulting mixture was heated at reflux for 7 hours, then was allowed to stand at room temperature for 16 hours. The reaction was monitored periodically by HPLC. After completion of the reaction, the mixture was partitioned between water (100 mL) and $CH_2Cl_2$-$Et_2O$ (1:31 250 mL), and the organic phase was washed successively with 50 mL portions of 5 percent NaOH, water, 5 percent HCl, water and brine, then it was dried ($MgSO_4$), filtered and concentrated. The residual oil was shaken thoroughly with a mixture of water (100 mL) and ethanol (25 mL), causing the product to separate as a white solid. This material was filtered off and washed with water-ethanol (3:1; 200 mL), and then was recrystallized from EtOAc-MeOH-$H_2O$ (20 mL: 100 mL: 10 mL), to afford 9.5 g (93 percent yield) of the title compound as a white crystalline solid, m.p. 148–149° C. which had a PDSC ($O_2$) onset/extrap (° C.) of 322/345.

Example 12: Bis[4-(diphenylphosphinyloxy)phenyl] Sulfone

An oven-dried 100 mL 3-necked flask equipped with a magnetic stirring bar, a reflux condenser carrying a $CaCl_2$-Drierite drying tube, and a heating mantle, was charged with 4,4'-sulfonyldiphenol (3.9 g, 15.6 mmol), 4-dimethylaminopyridine (0.39 g, 3.2 mmol), and anhydrous pyridine (35 mL), and the stirred solution was treated slowly with diphenylphosphinyl chloride (6.5 mL, 34.1 mmol) via syringe. The resulting mixture was heated at reflux for 7 hours, then was allowed to stand at room temperature for 16 hours. The reaction was monitored periodically by HPLC. After completion of the reaction, the mixture was partitioned between water (100 mL) and $CH_2Cl_2$-$Et_2O$ (1:3; 400 mL), and the organic phase was washed successively with 50 mL portions of 5 percent NaOH, water, 5 percent HCl, water and brine, then it was dried ($MgSO_4$), filtered and concentrated leaving a white solid residue. Recrystallization from ethyl acetate-THF (9:1) afforded 9.5 g (94 percent yield) of the title compound as a white fluffy solid, m.p. 210–211° C. which had a PDSC ($O_2$) onset/extrap (° C.) of 376/397.

Example 13: 9,9-Bis[4-(diphenylphosphinyl-oxy) phenyl]fluorene

An oven-dried 100 mL 3-necked flask equipped with a magnetic stirring bar, a reflux condenser carrying a $CaCl_2$-Drierite drying tube, and a heating mantle, was charged with 9,9-bis(4-hydroxyphenyl)fluorene (2.5 g, 13.4 mmol), 4-dimethylaminopyridine (0.33 g, 2.7 mmol), and anhydrous pyridine (35 mL), and the stirred solution was treated slowly with diphenylphosphinyl chloride (5.6 mL, 29.3 mmol) via syringe. The resulting mixture was heated at reflux for 8 hours. The reaction was monitored periodically by HPLC. After completion of the reaction, the mixture was poured into water (200 mL) with vigorous stirring, resulting in the separation of a white gummy material. The aqueous supernatant solution was decanted. The gummy material was dissolved in $CH_2Cl_2$ (100 mL), and the solution was washed successively with 100 mL portions of 5 percent NaOH, water, 5 percent HCl, water, and saturated brine, then was dried ($MgSO_4$), filtered and concentrated to leave a white foamy solid. Numerous attempts to crystallize this product from a variety of solvents were unsuccessful. Purification was finally accomplished by filtration through a column of flash-grade silica gel (3"×2" i.d.), eluting with $CH_2Cl_2$-$Et_2O$ (1:1, 500 mL), to afford 6.2 g (61 percent yield) of the title compound as a white foamy solid which had a PDSC ($O_2$) onset/extrap (° C.) of 293/342.

Example 14: Four-Ball Tests

The title compounds of Examples 9 and 12 were evaluated as lubricity additives to commercial 5P4E PPE fluid at 1 percent loading by the Four-Ball test method. The test conditions and results are summarized in Table II. In run 2, the title compound of Example 9 was used. In run 3, the title compound of Example 12 was used. It can be readily seen the additives provide wear-scar reduction, especially at high temperatures; thus, lubricity is reduced on addition of the title compounds.

TABLE II

| Sample | Average Wear Scar Diameter (mm) 75° C./15 Kg Load(2) | Average Wear Scar Diameter (mm) 204° C./7 Kg Load(2) |
|---|---|---|
| Run 1) 5P4E PPE Fluid | 1.73 | 0.83 |
| Run 2) 5P4E PPE Fluid +1% additive | 1.28 | 0.71 |
| Run 3) 5P4E PPE Fluid +1% additive | 1.76 | 0.67 |

(1)Not an embodiment of this invention.
(2)M-50 Steel Balls, 600 rpm, 1 hour

What is claimed is:

1. A composition useful for lubricating aircraft turbines, comprising:

(a) a lubricating fluid base stock and (b) a phosphorus-containing compound of Formula I:

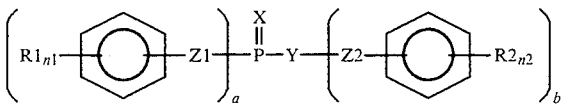

wherein a equals 1 or 2, b equals 1 or 2, X is oxygen or sulfur; Z1 and Z2 are independently in each occurrence a covalent bond or oxygen; Y is a covalent bond or is a diradical group of Formula II:

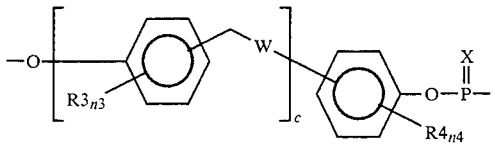

wherein c equals 0 or 1; R1, R2, R3 and R4 are independently in each occurrence aryl of up to 12 carbons, alkyl of up to 6 carbons, alkoxy of up to 6 carbons, polyhaloalkyl of up to 6 carbons, polyhaloalkyoxy of up to 6 carbons, halo or aryloxy of up to 12 carbons wherein if R1, R2, R3 or R4 is aryloxy the aryloxy can be substituted by one or more R1, R2, R3 or R4; W is a covalent bond, O, $SO_2$, $C(CH_3)_2$, $C(CF_3)_2$, or 9,9'-fluorene; n1 is 0 to 5; n2 is 0 to 5; n3 is 0 to 5; n4 is 0 to 5; with the provision that R1, R2, R3 and R4 are not hydroxy and with the provision that phosphorus is bonded to at least two oxygens and with the provision that a phosphorus atom is bonded to no more than three oxygens.

2. The composition of claim 1 wherein R1, R2, R3 and R4 are independently in each occurrence methyl, methoxy, polyhalomethyl, polyhalomethoxy, halo or aryloxy.

3. The composition of claim 1 wherein R1, R2, R3 and R4 are independently in each occurrence methyl, methoxy, polyfluoromethyl, polyfluoromethoxy, fluoro or phenyloxy.

4. The composition of claim 3 wherein a is 1; b is 2; n1 is 0, Z1 is a covalent bond, Z2 is oxygen, and Y is a covalent bond.

5. The composition of claim 4 wherein n2 is 1 and R2 is phenoxy or chlorophenoxy.

6. The composition of claim 5 wherein X is sulfur.

7. The composition of claim 1 wherein X is oxygen, a and b are 2, and Z1 and Z2 are covalent bonds.

8. The composition of claim 7 wherein c is 0.

9. The composition of claim 8 wherein R1, R2, R3 and R4 are independently in each occurrence methyl, methoxy, polyhalomethyl, polyhalomethoxy, halo or aryloxy.

10. The composition of claim 9 wherein R1, R2, R3 and R4 are independently in each occurrence methyl, methoxy, polyfluoromethyl, polyfluoromethoxy, fluoro or phenyloxy.

11. The composition of claim 8 wherein n1, n2, n3 and n4 are 0.

12. The composition of claim 1 wherein a and b are 2, X is oxygen and c is 1.

13. The composition of claim 12 wherein Z1 and Z2 are covalent bonds.

14. The composition of claim 13 wherein R1, R2, R3 and R4 are independently in each occurrence methyl, methoxy, polyhalomethyl, polyhalomethoxy, halo or aryloxy.

15. The composition of claim 14 wherein R1, R2, R3 and R4 are independently in each occurrence methyl, methoxy, polyfluoromethyl, polyfluoromethoxy, fluoro or phenyloxy.

16. The composition of claim 13 wherein n1, n2, n3 and n4 are 0.

17. The composition of any one of claims 1-16 wherein the lubricating fluid base stock is a polyphenyl ether.

18. The composition of claim 17 wherein the phosphorus-containing compound is present in an amount greater than about 0.5 weight percent and less than about 10 weight percent.

19. The composition of claim 18 wherein the phosphorus-containing compound is present in an amount less than about 5 weight percent.

* * * * *